US010890147B2

(12) United States Patent
Miyake et al.

(10) Patent No.: US 10,890,147 B2
(45) Date of Patent: Jan. 12, 2021

(54) FLOW CONTROL DEVICE

(71) Applicant: HITACHI AUTOMOTIVE SYSTEMS, LTD., Hitachinaka (JP)

(72) Inventors: Takao Miyake, Hitachinaka (JP); Kiyotaka Ogura, Hitachinaka (JP); Masashi Sugaya, Hitachinaka (JP); Takumi Takahashi, Hitachinaka (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 264 days.

(21) Appl. No.: 16/072,637

(22) PCT Filed: Jan. 19, 2017

(86) PCT No.: PCT/JP2017/001633
§ 371 (c)(1),
(2) Date: Jul. 25, 2018

(87) PCT Pub. No.: WO2017/168975
PCT Pub. Date: Oct. 5, 2017

(65) Prior Publication Data

US 2019/0040827 A1 Feb. 7, 2019

(30) Foreign Application Priority Data

Mar. 28, 2016 (JP) ..... 2016-062973

(51) Int. Cl.
*F02M 51/06* (2006.01)
*F02M 61/16* (2006.01)
(Continued)

(52) U.S. Cl.
CPC .... *F02M 51/0653* (2013.01); *F02M 51/0607* (2013.01); *F02M 51/0675* (2013.01);
(Continued)

(58) Field of Classification Search
CPC ..... F02M 51/0653; F02M 63/0017; F02M 51/0685; F02M 51/0607; F02M 51/168;
(Continued)

(56) References Cited

U.S. PATENT DOCUMENTS

2007/0194151 A1* 8/2007 Hayatani ..... F02M 51/0685 239/585.1
2008/0035761 A1* 2/2008 Akabane ..... F02M 51/0682 239/585.1
(Continued)

FOREIGN PATENT DOCUMENTS

GB 2 262 659 A 6/1993
JP H05-164012 A 6/1993
(Continued)

OTHER PUBLICATIONS

International Search Report with English translation and Written Opinion issued in corresponding application No. PCT/JP2017/001633 dated Apr. 11, 2017.

*Primary Examiner* — Sizo B Vilakazi
(74) *Attorney, Agent, or Firm* — Foley & Lardner LLP

(57) ABSTRACT

Provided is a fuel injection device that can secure strength capable of withstanding high fuel pressure. In a fuel injection device in which a fuel boundary includes two or more components, two components are press-fitted with an inner diameter and an outer diameter and are brought into contact at a butting surface, abutting welding is performed from a direction nearly parallel to the butting surface, an inner diameter side corner portion of the butting surface of a component to be fitted and press-fitted on an inner diameter side is chamfered longer in a direction perpendicular to the butting surface to increase a welding coupling length than a butting length, welding coupling length is less than welding depth, weld penetration depth is not less than material
(Continued)

thickness, and the center of the weld is on a base material side, the outer diameter of which is larger than a joining face.

12 Claims, 13 Drawing Sheets

(51) Int. Cl.
*F02M 63/00* (2006.01)
*F02M 61/18* (2006.01)

(52) U.S. Cl.
CPC ..... *F02M 51/0685* (2013.01); *F02M 61/168* (2013.01); *F02M 63/0017* (2013.01); *F02M 51/0628* (2013.01); *F02M 61/1873* (2013.01); *F02M 2200/8061* (2013.01); *F02M 2200/8084* (2013.01)

(58) Field of Classification Search
CPC ..... F02M 51/0675; F02M 61/1873; F02M 2200/8061; F02M 51/0628; F02M 2200/8084
See application file for complete search history.

(56) References Cited

U.S. PATENT DOCUMENTS

2008/0296414 A1* 12/2008 Kubota ..... F02M 61/18 239/533.11
2011/0204276 A1* 8/2011 Huemmer ..... F02M 61/168 251/366
2012/0227709 A1* 9/2012 Kusakabe ..... F02M 51/061 123/472
2014/0367498 A1* 12/2014 Takaoku ..... F02M 51/061 239/584

FOREIGN PATENT DOCUMENTS

JP H11-166461 A 6/1999
JP H11-193762 A 7/1999
JP 2001-071161 A 3/2001
JP 2005-240732 A 9/2005
JP 2006-029259 A 2/2006
JP 2007-218205 A 8/2007
JP 2012-188977 A 10/2012
JP 2013-164027 A 8/2013

* cited by examiner

FLOW CONTROL DEVICE

TECHNICAL FIELD

The present invention relates to a flow control device.

BACKGROUND ART

As an example of a conventional art, disclosed is that an electromagnetic fuel injection valve device is formed by a welding joint structure, in which a movable valve is formed by an electromagnetic core and a movable needle portion each having a different material composition, in the movable valve formed by welding and joining the electromagnetic core and the movable needle portion, an electromagnetic core end face portion and the movable needle portion are abut-welded, a flange portion is formed at the movable needle portion and an abutting surface of the flange portion and the electromagnetic core end face portion, and a melted portion is formed such that a weld penetration depth is larger than a length of the abutting surface (See, for example, FIG. 2 of PTL 1).

By abutting at least a part of the movable needle portion and the electromagnetic core, and applying YAG laser light to an abutting portion to perform welding by a distance longer than the abutting surface, it is possible to mass-produce and provide a fuel injection valve having excellent durability.

CITATION LIST

Patent Literature

PTL 1: JP H11-193762 A

SUMMARY OF THE INVENTION

Technical Problem

In the fuel injection valve of the embodiment described in Patent Literature 1, it is described that a weld penetration depth is made larger than the abutting surface length of an abutting weld portion. However, there is no description of contrivance concerning the shape and melting of the nook portion and corner portion of an abutted portion and the shape of a metal after re-solidification.

In recent exhaust gas regulations, it is necessary to reduce the amount and quantity of particulate matter contained in an exhaust gas. Even in a fuel injection valve using gasoline, there is a possibility that a maximum fuel pressure can be increased to about 35 MP. When a normal maximum fuel pressure is 35 MPa, the fuel injection valve is required to hold the fuel up to 55 MPa, for example.

Then, a larger stress is generated in the weld portion due to the fuel pressure than in the conventional art, and there is a possibility that the margin to the strength decreases.

An object of the present invention is to reduce the manufacturing cost of a fuel injection device capable of securing the strength of a weld portion that can withstand a high fuel pressure and to provide the fuel injection device at low cost.

Solution to Problem

In order to achieve the above object, the present invention provides a flow control device including a first component and a second component having an opposing surface facing one surface of the first component, including: abutting surface that makes mutual contact between the one surface of the first component and the opposing surface of the second component; and a weld portion formed along the butting surface on the butting surface of the first component and the second component, wherein an air gap is formed by the weld portion, the first component, and the second component, and a welding direction tip end portion of the weld portion is positioned on a welding direction side with respect to a welding direction tip end portion of the butting surface.

Advantageous Effects of Invention

According to the present invention, it is possible to provide an inexpensive fuel injection device by ensuring the welding strength capable of withstanding high fuel pressure by the necessary minimum welding. The problems, configurations, and effects other than those described above will be clarified from the description of the embodiments below.

DESCRIPTION OF EMBODIMENTS

Figure 1A:
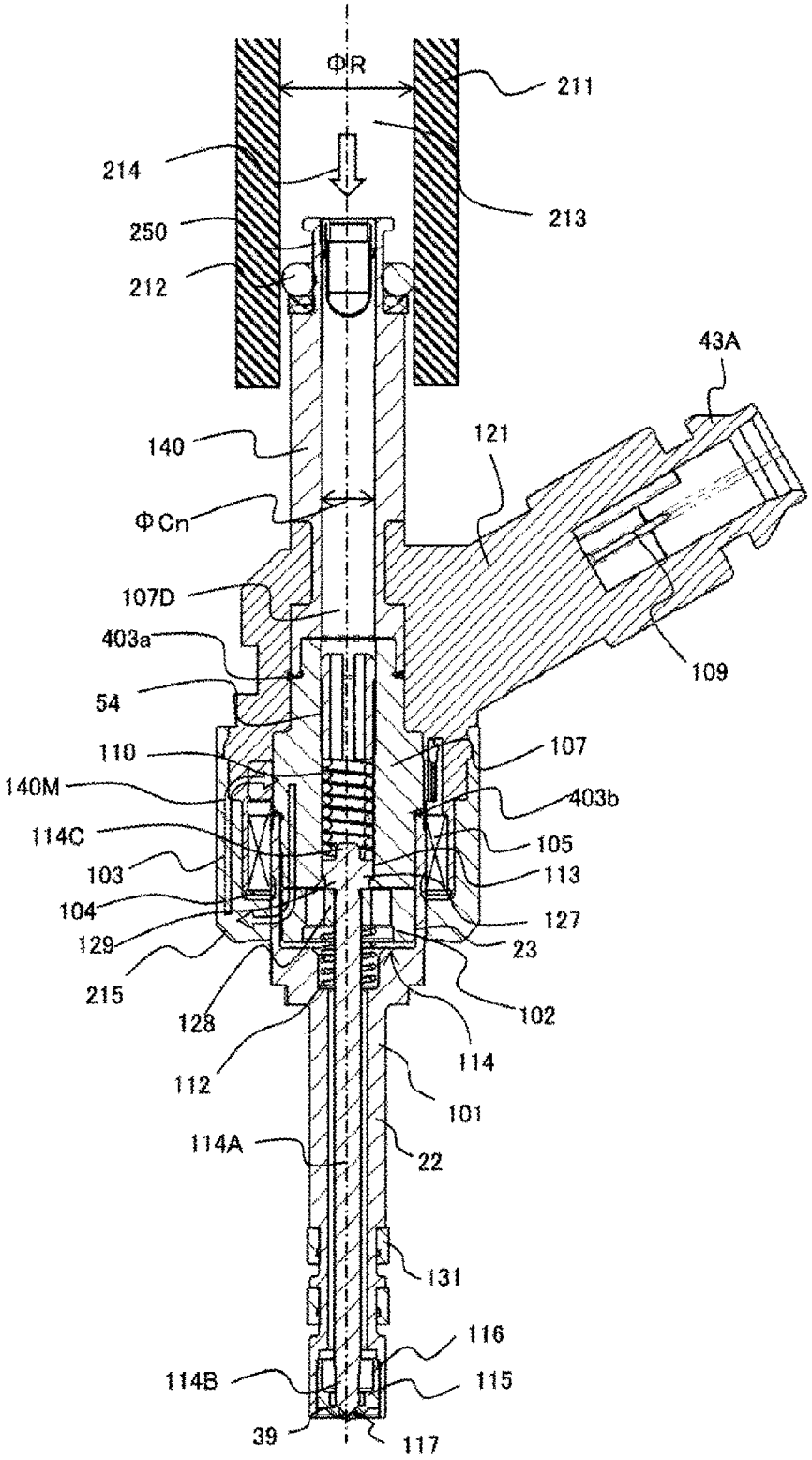
FIG. 1A is a cross-sectional view of a part of a fuel injection device and a fuel pipe according to an embodiment of the present invention.

Hereinafter, a specific mode for carrying out the present invention will be described with reference to the drawings.

Embodiment

Embodiments of a flow control device of the present invention, in particular, the configuration and effects thereof will be described below in detail with reference to the drawings. In the present embodiment, a fuel injection valve (fuel injection device) will be described as an example of a flow control device, but the present invention is not limited to this. For example, in a high-pressure fuel pump in which there is a possibility that the strength of the weld portion may not be maintained due to the occurrence of a large stress in the weld portion by the high fuel pressure, the present invention can also be applied to two components joined in the weld portion. In the drawings, in order to make the function easy to understand, the size of a component and the size of a gap may be exaggerated over the actual ratio, and an unnecessary component may be omitted to explain the function. In the respective embodiments, the same reference numerals are given to the same constituent elements, and duplicate explanation is omitted.

Figure 1B:
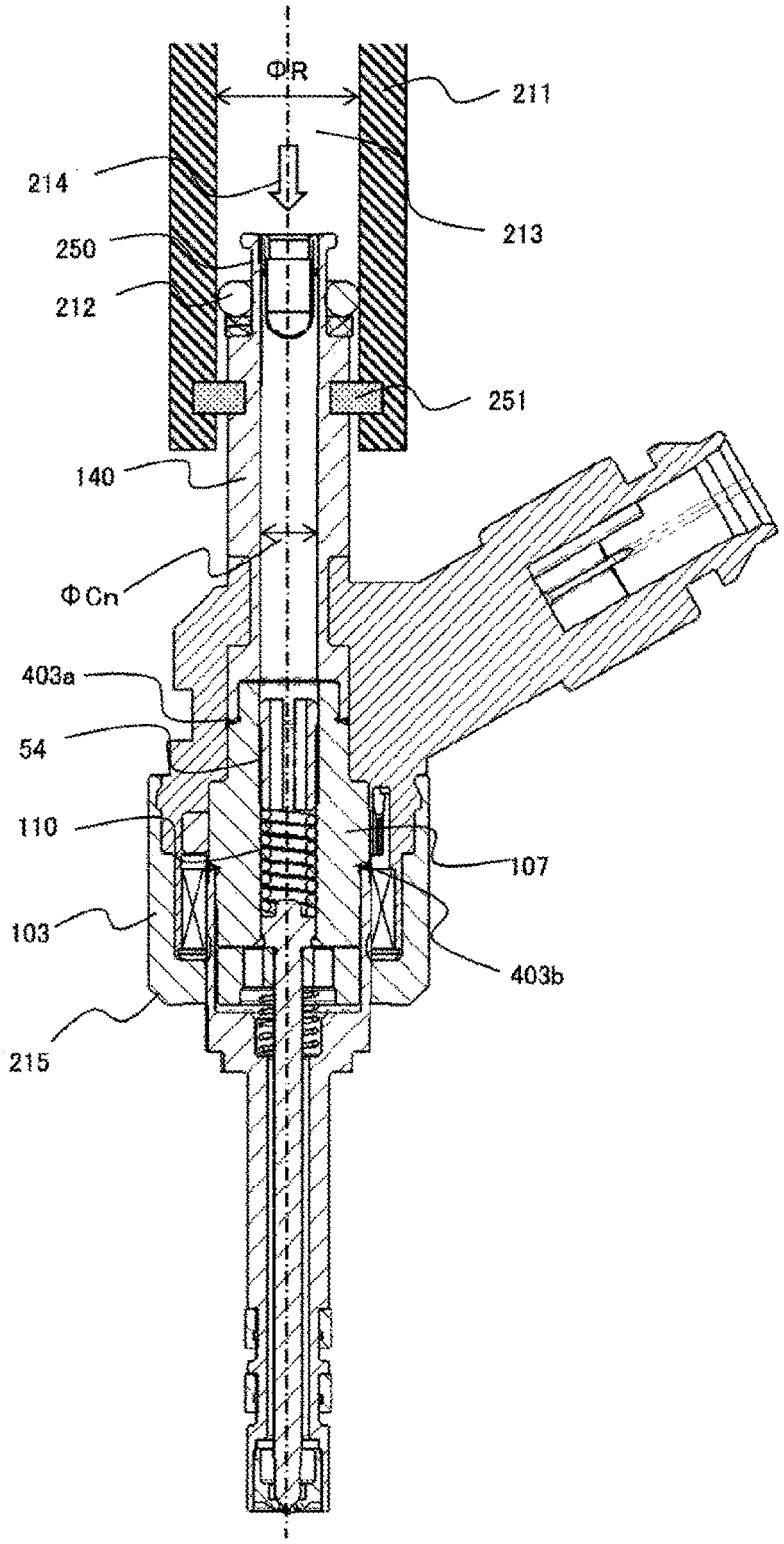
FIG. 1B is another sectional view of a part of the fuel injection device and the fuel pipe according to the embodiment of the present invention.

First, with reference to FIGS. 1A and 1B, the outline of the configuration of the fuel injection valve according to the present embodiment will be described. FIGS. 1A and 1B are longitudinal sectional views of the fuel injection valve according to the present embodiment.

An internal combustion engine is provided with a fuel injection control device (not illustrated) that performs calculation of converting an appropriate fuel amount according to an operating state into injection time of the fuel injection valve and drives the fuel injection valve that supplies fuel.

As illustrated in FIG. 1A, in the fuel injection valve, for example, a movable portion 114 is configured to include a cylindrical movable element 102 and a needle valve 114A (valve body) positioned at the center of the mover 102. A gap is provided between an end face of a fixed core 107 (stator) having a fuel introduction hole for guiding a fuel to a center portion and an end face of the mover 102. An electromagnetic coil 105 (solenoid) that supplies a magnetic flux to a magnetic path including the gap is provided. In other words, as illustrated in FIG. 1A, the fixed core 107 (stator) is arranged to face the mover 102.

The mover 102 is driven by attracting the mover 102 to a fixed core 107 side by a magnetic attraction force generated between the end surface of the mover 102 and the end surface of the fixed core 107 by a magnetic flux passing through the gap, and the needle valve 114A is pulled away from a valve seat portion 39 (valve seat) to open a fuel passage provided in the valve seat portion 39. In other words, the mover 102 drives the needle valve 114A (valve body).

The amount of fuel to be injected is mainly determined by a differential pressure between the pressure of a fuel and the atmospheric pressure of an injection port of the fuel injection valve, and a time during which the fuel is being injected while keeping the needle valve 114A in an opened state.

When the energization to the electromagnetic coil 105 is stopped, a magnetic attraction force acting on the mover 102 disappears, the needle valve 114A and the mover 102 are moved in a closing direction by a force of an elastic member for urging the needle valve 114A in the closing direction and a pressure drop caused by a flow velocity of a fuel flowing between the needle valve 114A and the fixed core 107, and the needle valve 114A is seated on the valve seat portion 39, so that the fuel passage is closed. The fuel is sealed by the abutting between the needle valve 114A and the valve seat portion 39 to prevent a fuel from leaking out of the fuel injection valve at an unintended timing.

In recent years, from the viewpoint of reducing fuel consumption, an attempt has been made to reduce the amount of fuel consumed when mounted in the vehicle, by reducing the displacement of an internal combustion engine in combination with a supercharger and using an operation region with high thermal efficiency. In this attempt, it is effective to combine with an in-cylinder direct injection type internal combustion engine which is expected to improve the filling amount of the intake air charge due to the vaporization of the fuel and improve the anti-knocking characteristic.

Furthermore, since a large reduction in fuel consumption is required for a wide range of vehicles, demand for an in-cylinder direct injection type internal combustion engine increases, and on the other hand, it is necessary to mount a device that is effective in reducing other fuel consumption such as recovery of regenerative energy, on a vehicle. Furthermore, from the viewpoint of reducing the total cost, cost reduction of various devices is required, and a cost reduction requirement on the fuel injection valve for in-cylinder direct injection also increases as well.

On the other hand, it is also required to further reduce the components contained in an exhaust gas of the internal combustion engine, and in particular, from the viewpoint of reducing the amount and quantity of particulate matter, an attempt has been made to increase the fuel injection pressure from the conventional 20 MPa to, for example, about 35 MPa, to reduce the droplet particle size of a fuel to be injected and promote vaporization.

When the fuel pressure is increased, a load applied in the axial direction also increases in proportion to a fuel passage area of a fuel pipe 211 and the fuel injection valve. Therefore, in order to constitute a fuel injection valve that can withstand a high fuel pressure, it is necessary to reduce a fuel passage diameter at the connection portion with the fuel pipe 211 so as to reduce the axial load.

Likewise, when increasing a fuel pressure, stress generated in a member that holds an internal fuel pressure with respective to the outside of the fuel injection valve increases. In order to have a margin of strength against the stress generated at high fuel pressure, it is necessary to increase the thickness to ensure rigidity or to use a material with high strength.

However, as described above, in order to reduce a load to be applied in the axial direction, it is necessary to reduce a load in the axial direction by decreasing the diameter of the fuel passage at a connection portion with the fuel pipe 211 while securing the inner diameter for accommodating the needle valve 114A, a spring 110, and an adjuster 54 in the fuel injection valve interior; therefore, it is difficult to increase a wall thickness. It is effective to select a material with high yield stress and tensile strength in order to maintain margin against strength even with high stress.

Since the fixed core 107 of the fuel injection valve constitutes a part of an electromagnetic solenoid, a material excellent in a magnetic property is used. The material excellent in a magnetic property generally has low yield stress and tensile strength, so that the material is not suitable for use as the connection portion with the fuel pipe 211, which requires a small wall thickness and high rigidity as described above.

Therefore, in the fuel injection valve corresponding to the high fuel pressure, division into two components of the fixed core 107 and the adapter 140 is performed. A material having a higher yield stress and tensile strength than the fixed core 107 is used for the adapter 140, a material excellent in a magnetic property is used for the fixed core 107, and after the two parts are press-fitted in a radial direction, the two parts may be fixed by full circumference welding at 403*a*.

Therefore, with respect to an increase in the fuel pressure, it is possible to manufacture a fuel injection valve that does not deteriorate the magnetic property of the fixed core 107 while reducing a fuel passage diameter with the fuel pipe 211 to reduce the load in the axial direction while suppressing an increase in cost.

For the same reason, division into two components of the fixed core 107 and a nozzle holder 23 is performed. A material having a higher yield stress and tensile strength than the fixed core 107 is used for the nozzle holder 23, a material excellent in a magnetic property is used for the fixed core 107, and after the two parts are press-fitted in a radial direction, the two parts may be fixed by full circumference welding at 403*b*.

In the upper part of FIG. 1A, the load to be applied in the axial direction of the fuel injection valve by the fuel pressure is schematically illustrated. Since the fuel injection valve is connected to the fuel pipe 211 and the fuel is sealed by the O ring 212, the fuel pipe interior 213 and the fuel injection valve interior are filled with high pressure fuel. A fuel pipe cross-sectional area is determined by a fuel pipe inner diameter φR, and the product of a fuel pipe cross-sectional area and a fuel pressure is defined as a fuel pressure load.

Since the fuel pipe 211 is fixed to an engine (not illustrated), the fuel injection valve receives a fuel pressure load in the direction of an arrow 214. Since the fuel injection valve is in contact with the engine (not illustrated) by, for example, a tapered surface 215 of a housing 103, the above-described fuel pressure load is transmitted via the adapter 140, the fixed core 107, an injection hole cup support 101, and a housing 103, which constitute the fuel injection valve.

In the fuel injection valve illustrated in FIG. 1B, the fuel injection valve is suspended from the fuel pipe 211 via a plate 251 and positioned.

Figure 2:
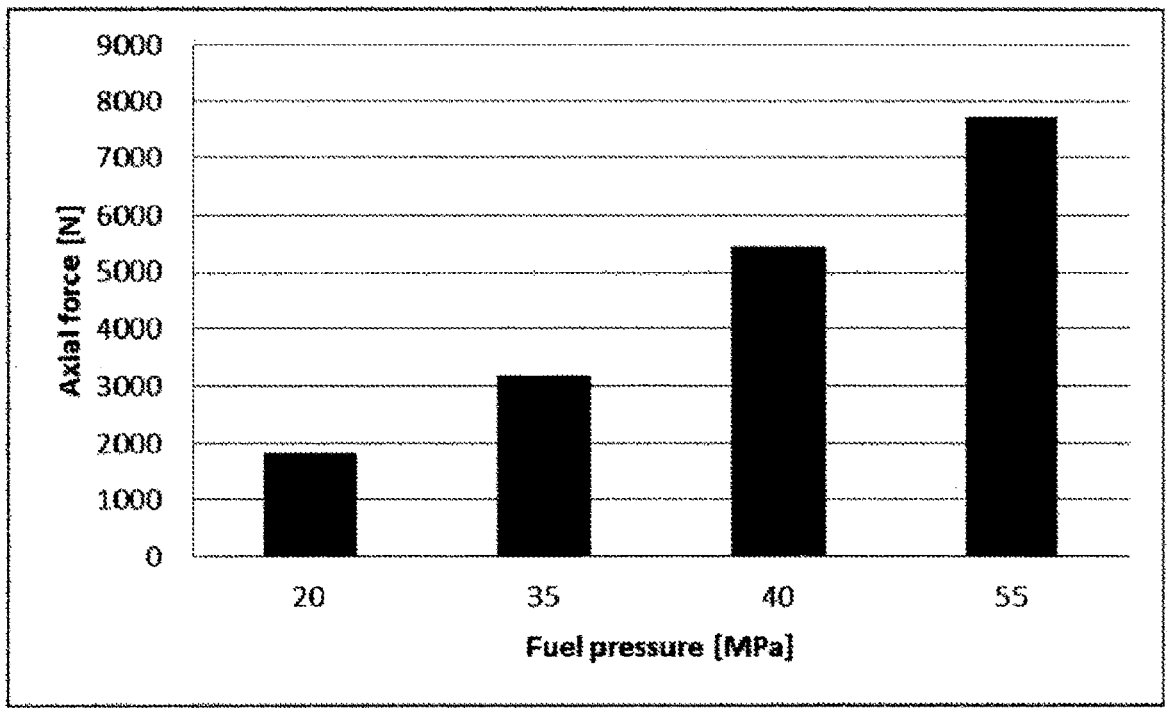
FIG. 2 is a graph illustrating a relationship between a fuel pressure in a fuel injection valve interior and a load applied in a fuel injection valve axial direction.

FIG. 2 is a graph in which a load in the axial direction of the fuel injection device with respect to a fuel pressure to be applied to the fuel injection valve interior is calculated. Conventionally, the maximum fuel pressure is used at 20 MPa, for example, and the load to be applied in the axial direction of the fuel injection valve by the fuel pressure at that time is, for example, 1800N. When the fuel pressure is set to 35 MPa, the fuel pressure load becomes 3200N which is approximately 1.5 times. Further, in a system with a fuel pressure of 35 MPa, considering safety margin, it is necessary to maintain the structural strength up to, for example, a fuel pressure of 55 MPa, and in that case, an axial load reaches approximately 7700 N. As described above, since the axial load due to the fuel pressure is transmitted to the components constituting the fuel injection valve, the stress generated in each component increases as the fuel pressure increases. In a case where the shape, material and welding shape of the components constituting the fuel injection valve are not conventionally changed, the margin of strength decreases. On the other hand, using a high strength material and a complicated welding method leads to an increase in cost.

In either case, in the fuel injection valve, after the two components are press-fitted in the radial direction, the components are fixed by full circumference welding. Since a load to be applied to a weld fixing portion increases with the fuel pressure, it is necessary to provide an inexpensive fuel injection device by securing welding strength that can withstand high fuel pressure by a necessary minimum welding.

(Details of Configuration)

Next, the configuration of the fuel injection valve according to the embodiment of the present invention will be described in detail with reference to FIGS. 1A to 6B.

First, the operation of the fuel injection valve will be described with reference to FIG. 1A.

The injection hole cup support 101 is provided with a small diameter cylindrical portion 22 having a small diameter and a large diameter cylindrical portion 23 having a large diameter. An injection hole cup 116 (fuel injection hole forming member) having a guide portion 115 and a fuel injection hole 117 is inserted or press-fitted into the tip end portion of the small diameter cylindrical portion 22, and the full circumference of the tip end face of the injection hole cup 116 on the outer circumference is welded. As a result, the injection hole cup 116 is fixed to the small diameter cylindrical portion 22. The guide portion 115 has a function of guiding the outer circumference when a valve body tip end portion 114B provided at a tip end of the needle valve 114A constituting the movable portion 114 moves up and down in the axial direction of the fuel injection valve.

In the injection hole cup 116, a conical valve seat portion 39 is formed on the downstream side of the guide portion 115. The valve body tip end portion 114B provided at the tip end of the needle valve 114A abuts against or separates from the valve seat portion 39 so as to shut off a fuel flow or to lead the fuel flow to a fuel injection hole. A groove is formed on the outer circumference of the injection hole cup support 101, and a sealing member of a combustion gas represented by a chip seal 131 made of a resin material is fitted into this groove.

A needle valve guide portion 113 (needle valve guide member) for guiding the needle valve 114A constituting the mover is provided at an inner circumference lower end portion of the fixed core 107. The needle valve 114A is provided with a guide portion 127, and although not illustrated, the guide portion 127 partly has a chamfered portion to form a fuel passage. The elongated needle valve 114A is defined in a radial position by the needle valve guide portion 113 and is guided so as to reciprocate straight in the axial direction. It should be noted that a valve opening direction is upward in a valve axial direction and a valve closing direction is a direction heading downward in the valve axial direction.

A head portion 114C having a stepped portion 129 having an outer diameter larger than the diameter of the needle valve 114A is provided at an end portion opposite to an end portion of the needle valve 114A where the valve body tip end portion 114B is provided. A seating surface of the spring 110 for urging the needle valve 114A in the valve closing direction is provided on an upper end surface of the stepped portion 129 and holds the spring 110 together with the head portion 114C.

The movable portion 114 has the mover 102 having a through hole 128 at the center through which the needle valve 114A passes. A zero spring 112 that urges the mover 102 in the valve opening direction is held between the mover 102 and the needle valve guide portion 113.

Since the diameter of the through hole 128 is smaller than the diameter of the stepped portion 129 of the head portion 114C, under the action of an urging force of the spring 110 pressing the needle valve 114A against the valve seat of the injection hole cup 116 or the gravity, an upper side surface of the mover 102 held by the zero spring 112 abuts against a lower end surface of the stepped portion 129 of the needle valve 114A, and the upper side surface and the lower end surface are in engagement with each other.

As a result, the upper side surface and the lower end surface cooperate to move with respect to the upward movement of the mover 102 against the urging force of the zero spring 112 or the gravity, and the movement of the downward needle valve 114A along the urging force of the zero spring 112 or gravity. Regardless of the urging force of the zero spring 112 or gravity, when a force for moving the needle valve 114A upward or a force for moving the mover 102 downward acts independently on the upper side surface and the lower end surface, the upper side surface and the lower end surface can move in different directions.

A fixed core 107 is press-fitted to the inner peripheral portion of the large diameter cylindrical portion 23 of the injection hole cup support 101, and is welded and joined at a press-fit contact position. By this welding and joining, a gap formed between the inside of the large diameter cylindrical portion 23 of the injection hole cup support 101 and the outside air is hermetically sealed. In the fixed core 107, a through hole 107D having a diameter φCn at the center is provided as a fuel introduction passage.

In other words, the lower surface (downstream surface) of the adapter 140 (pipe) and the upper surface (upstream surface) of the fixed core 107 (stator) are directly in contact with each other, whereby the adapter 140 and the fixed core 107 are fixed by press fitting.

Plating may be performed on a lower end surface of the fixed core 107 and an upper end surface and a collision end surface of the mover 102 to improve the durability. Even when relatively soft magnetic stainless steel is used for the mover 102, by using hard chromium plating or electroless nickel plating, durability reliability can be secured.

A lower end of the initial load setting spring 110 abuts against a spring receiving surface formed on the upper end surface of the stepped portion 129 provided on the head portion 114C of the needle valve 114A, and the other end of the spring 110 is received by the adjuster 54. Thereby, the spring 110 is held between the head portion 114C and the adjuster 54. By adjusting the fixing position of the adjuster 54, it is possible to adjust an initial load with which the spring 110 presses the needle valve 114A against the valve seat portion 39.

The cup-shaped housing 103 is fixed to the outer circumference of the large diameter cylindrical portion 23 of the injection hole cup support 101. The through hole is provided at the center of the bottom of the housing 103, and the large diameter cylindrical portion 23 of the injection hole cup support 101 is inserted through the through hole. An outer circumferential wall portion of the housing 103 forms an outer circumferential yoke portion facing an outer circumferential surface of the large diameter cylindrical portion 23 of the injection hole cup support 101.

The electromagnetic coil 105 wound so as to form an annular shape is disposed in a cylindrical space formed by the housing 103. The electromagnetic coil 105 is formed of an annular coil bobbin 104 having a U-shaped groove having a cross section opening radially outward, and a copper wire wound in the groove. A rigid conductor 109 is fixed to a winding start end portion and a winding end portion of the electromagnetic coil 105, and is drawn out from a through hole provided in the fixed core 107.

The outer circumference of the conductor 109, and the large diameter cylindrical portion 23 of the fixed core 107 and the injection hole cup support 101 is molded by injecting insulating resin from the inner circumference of the upper end opening of the housing 103, and is covered by the resin molded body 121. In this way, a toroidal magnetic path is formed around the electromagnetic coil (104, 105).

A plug for supplying power from a high voltage power supply and a battery power supply is connected to the connector 43A formed at the tip end of the conductor 109, and energization and non-energization are controlled by a controller (not illustrated). While the electromagnetic coil 105 is energized, a magnetic attraction force is generated between the mover 102 of the movable portion 114 and the fixed core 107 at a magnetic attraction gap by a magnetic flux passing through a magnetic circuit 140M, and the mover 102 moves upward by suction with a force exceeding the set load of the spring 110.

At this time, the mover 102 engages with the head portion 114C of the needle valve and moves upward together with the needle valve 114A to move until the upper end surface of the mover 102 collides with the lower end surface of the fixed core 107. As a result, the valve body tip end portion 114B of the tip end of the needle valve 114A separates from the valve seat portion 39, the fuel passes through the fuel passage, and is injected into the combustion chamber of the internal combustion engine from the fuel injection hole 117 provided at the tip end of the injection hole cup 116.

While the valve body tip end portion 114B at the tip end of the needle valve 114A is separated from the valve seat portion 39 and is pulled upward, the elongated needle valve 114A is guided so as to return straight along the valve axial direction at two positions of the needle valve guide portion 113 and the guide portion 115 of the injection hole cup 116.

When the electromagnetic coil 105 is de-energized, the magnetic flux disappears and the magnetic attraction force in the magnetic attraction gap also disappears. In this state, a spring force of the initial load setting spring 110 pushing the head portion 114C of the needle valve 114A in the opposite direction overcomes a force of the zero spring 112, so that the spring force of the initial load setting spring 110 acts on the entire movable portion 114 (the mover 102 and the needle valve 114A). As a result, the mover 102 is pushed back by the spring force of the spring 110 to a valve closing position where the valve body tip end portion 114B is in contact with the valve seat portion 39.

While the valve body tip end portion 114B at the tip end of the needle valve 114A comes into contact with the valve seat portion 39 and is in the valve closing position, the elongated needle valve 114A is guided only by the needle valve guide portion 113, and is not in contact with the guide portion 115 of the injection hole cup 116.

At this time, the stepped portion 129 of the head portion 114C abuts against the upper surface of the mover 102 to move the mover 102 to the side of the needle valve guide portion 113 by overcoming the force of the zero spring 112. When the valve body tip end portion 114B collides with the valve seat portion 39, since the mover 102 is separate from the needle valve 114A, the movement toward the needle valve guide portion 113 is continued by the inertial force. At this time, fluid friction occurs between an outer circumference of the needle valve 114A and an inner circumference of the mover 102, and the energy of the needle valve 114A that bounces back from the valve seat portion 39 in the valve opening direction is absorbed.

Since the mover 102 having a large inertial mass is disconnected from the needle valve 114A, the rebounding energy itself is also reduced. Furthermore, the mover 102 that has absorbed the bouncing energy of the needle valve 114A decreases by its own inertial force accordingly and a repulsive force received after compressing the zero spring 112 also decreases; therefore, a phenomenon that the needle valve 114A is moved again in the valve opening direction due to the bouncing phenomenon of the movable element 102 itself hardly occurs. Thus, the rebound of the needle valve 114A is minimized, and the valve is opened after the electromagnetic coil 105 is de-energized, so that a so-called secondary injection phenomenon in which fuel is injected in a random manner is suppressed.

Figure 3A:
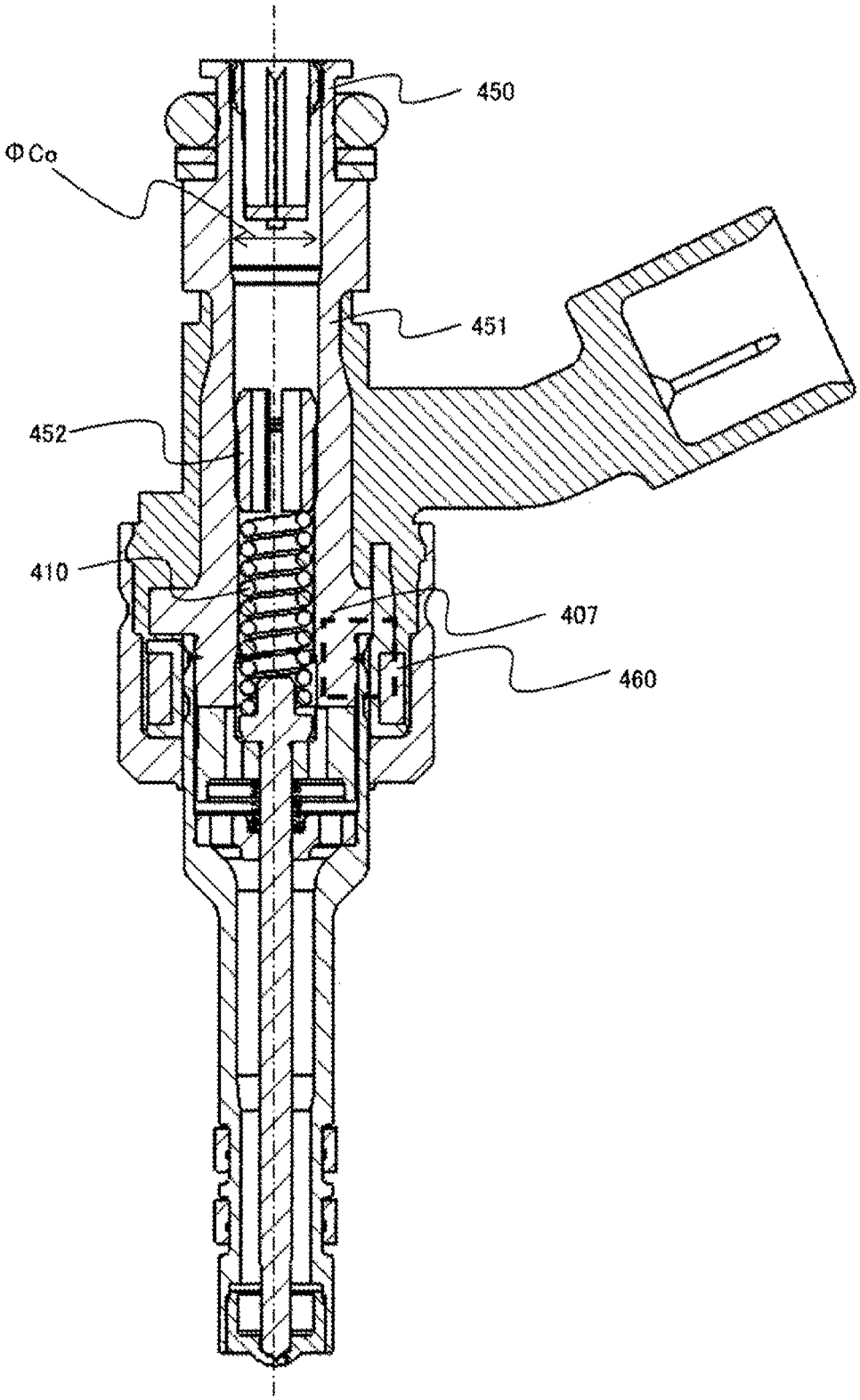
FIG. 3A is an overall cross-sectional view of the fuel injection device according to a comparative example.

FIG. 3A illustrates a sectional view of a fuel injection valve according to a comparative example. After a fixed core 407 is press-fitted into the nozzle holder 23, the fixed core 407 is joined by lap welding.

Figure 3B:
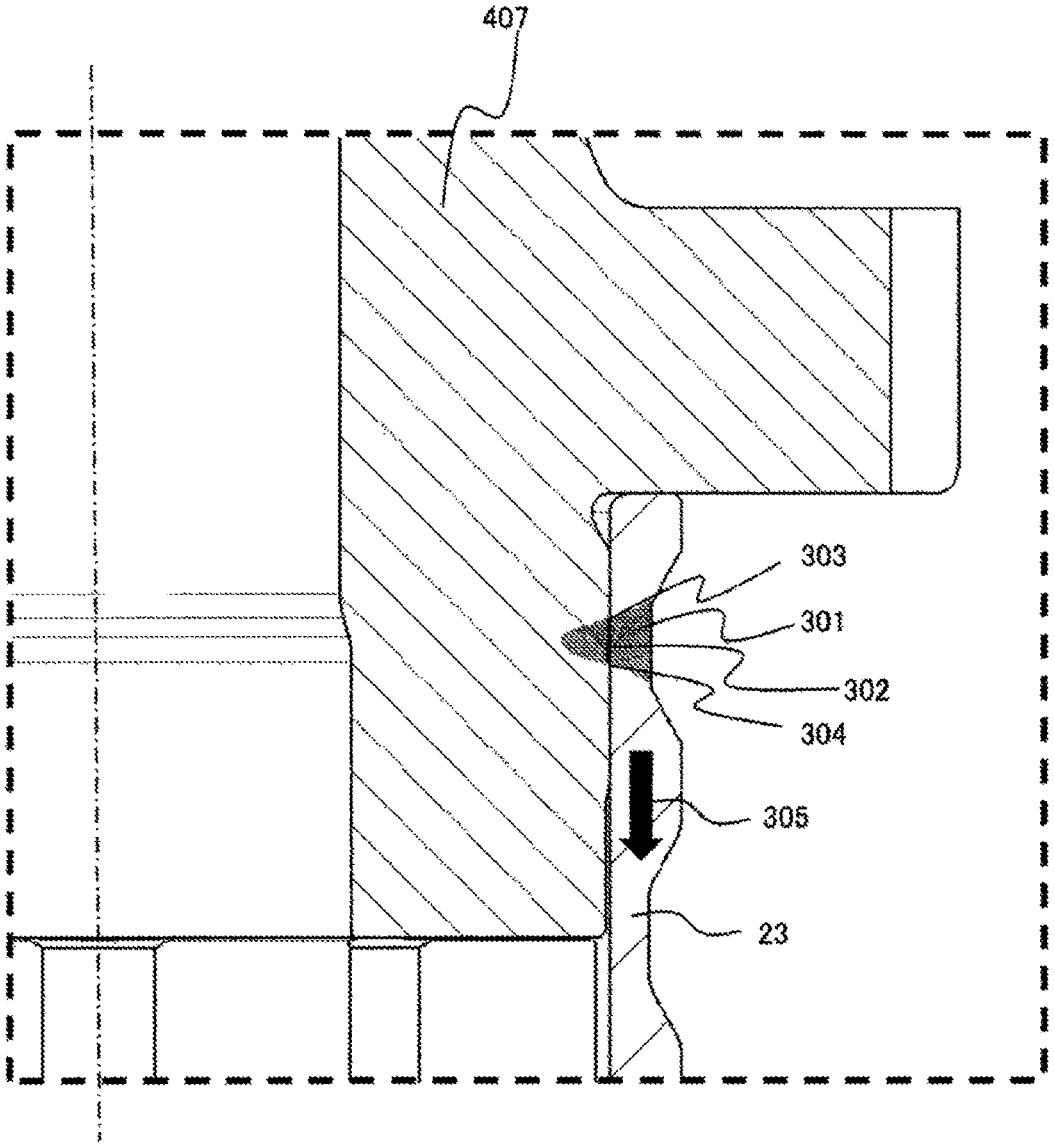
FIG. 3B is an enlarged sectional view of a weld portion of the fuel injection device according to the comparative example.

FIG. 3B is an enlarged view of a vicinity 460 of a lap weld portion of the fuel injection valve illustrated in FIG. 3. Although the nozzle holder 23 receives a load 305 in an outer diameter direction and downward in the fuel injection valve axial direction by the fuel pressure, the fixed core 407 is fixed in the axial direction; therefore, the nozzle holder 23 receives a load which mainly acts on the lap weld portion 301 downward in the fuel injection valve axial direction by the fuel pressure.

When a boundary surface between the fixed core 407 and the nozzle holder 23 during lap welding is 302, a shear load is generated at the boundary surface 302. A high stress is generated at an upper end 303 of the boundary surface 302 due to the shear load. This is because even if the length of the boundary surface 302 during lap welding is increased, stress is concentrated on the upper end 303 when a load downward in the fuel injection valve axial direction is applied to the nozzle holder 23.

When a fuel pressure is 20 MPa, as illustrated in FIG. 2, since the axial load is small, stress generated at the upper end 303 of the boundary surface 302 is relatively small, and sufficient strength can be secured.

On the other hand, when the fuel pressure is higher than the conventional one, for example, when the fuel pressure is used at 35 MPa, the axial load increases as illustrated in FIG. 2. Therefore, since the load direction and the base material boundary are parallel to each other in the lap welding, stress generated in a base material and a weld boundary portion by the shearing force also increases, and there is a possibility that sufficient strength cannot be secured.

Figure 4A:
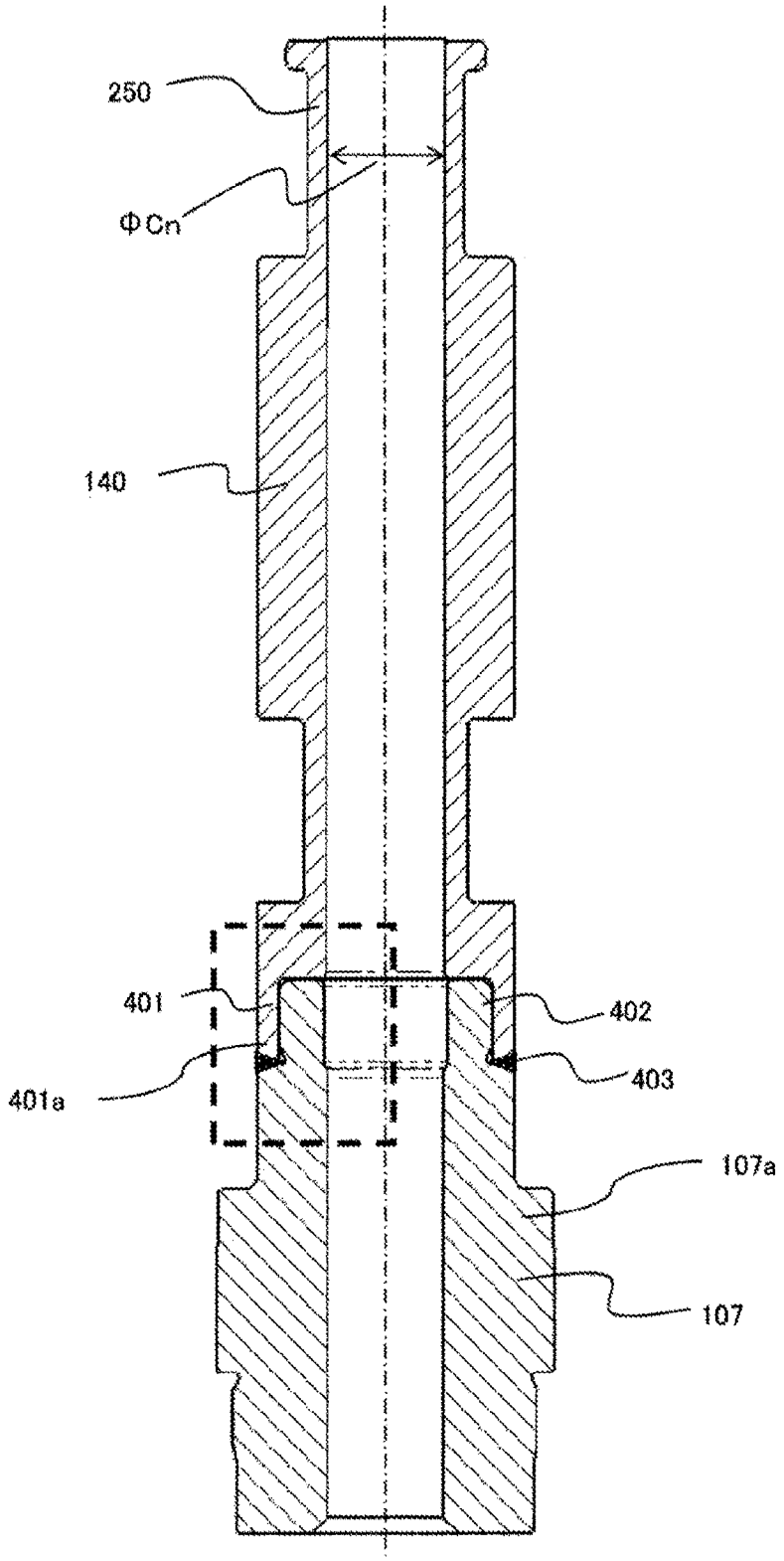
FIG. 4A is a cross-sectional view of a component of the fuel injection device according to the embodiment of the present invention.

FIG. 4A is a sectional view of only the adapter 140 and the fixed core 107 constituting the fuel injection valve according to the embodiment of the present invention. Since the thickness of an O-ring mounting portion 250 of the adapter 140 is small, a material having high strength is selected. Because the material is a selected material giving priority to strength, the material can withstand stress generated at a fuel pressure of 35 MPa. Since the fixed core 107 constitutes a magnetic circuit, there is no thin portion. Therefore, a material excellent in magnetism is selected for the fixed core 107. Even if a material with low strength is selected due to its large wall thickness, the material can withstand stress generated at a fuel pressure of 35 MPa.

In other words, a saturation magnetic flux density of the fixed core 107 (stator) is larger than a saturation magnetic flux density of the adapter 140 (pipe) which is made of a member separate from the fixed core 107 and is directly fixed to the fixed core 107 by press fitting. Thereby, for example, the manufacturing cost of the adapter 140 can be reduced while securing the magnetic property of the fixed core 107.

Here, a tensile strength of the fixed core 107 (stator) is smaller than a tensile strength of the adapter 140 (pipe) directly fixed to the fixed core 107 by press fitting. Thus, for example, even if the shape of the fixed core 107 becomes complicated while securing the strength of the adapter 140, it is possible to easily perform the processing.

The abutting portion includes a component A and a component B, and it is necessary to hold a high pressure fuel filled in a fuel injection valve interior 601.

An attachment portion 401 of the adapter 140 of the fuel injection valve and an attachment portion 402 of the fixed core 107 are in contact with each other in the radial direction, press-fitted, and subjected to a full circumference abutting welding at an abutting weld portion 403 in order to seal the fuel. Since the attachment portion 401 of the adapter 140 and the attachment portion 402 of the fixed core 107 are press-fitted and fixed before welding, it is possible to suppress the collapse of the adapter 140 caused by a strain generated at the time of welding.

In other words, the fixed core 107 (stator) has the attachment portion 402 (stator side attachment portion) on the upstream side and the adapter 140 (pipe) has the attachment portion 401 (pipe side attachment portion) on the downstream side. The attachment portion 402 and the attachment portion 401 are directly in contact with each other and press-fitted in the radial direction. As a result, it is possible to easily manufacture the attachment portion 402 and the attachment portion 401, and press fitting and fixing can be performed by the attachment portion 402 and the attachment portion 401.

Further, a downstream tip end portion 401*a* of the attachment portion 401 (pipe side attachment portion) comes into contact with an upper surface (upstream surface) of the attachment portion 402 (stator side attachment portion), and abutting welding is performed at this contact portion. Specifically, the attachment portion 401 (pipe side attachment portion) is positioned on the outer circumference side than the attachment portion 402 (stator side attachment portion), the downstream tip end portion 401*a* of the attachment portion 401 comes into contact with the fixed core 107 in the axial direction, and abutting welding is performed at this contact portion.

As a result, it is possible to perform abutting welding of the attachment portion 402 and the attachment portion 401, and the attachment portion 402 and the attachment portion 401 can be manufactured and fixed firmly at low cost. Since a material used for the adapter 140 is stronger than the fixed core 107, it is reasonable to place the adapter 140 on the outer circumferential side where stress is high. Moreover, a material with high strength can be made thinner, and is easy to weld.

Here, the fixed core 107 (stator) is formed of a member in which a protruding portion 107*a* (a flange portion) protruding toward an outer circumferential side is formed on the downstream side of the attachment portion 402 (stator side attachment portion), and the protruding portion 107*a* is integral with the fixed core 107. Further, the fixed core 107 is formed by cold forging. As a result, even if there is the protruding portion 107*a*, it is possible to reduce waste of material and to achieve low cost manufacturing.

If a harder member that cannot adopt cold forging is adopted for the fixed core 107, it is necessary to cut out the fixed core 107 by machining, including the protruding portion 107*a* (flange portion). In this case, many parts are wasted, which is disadvantageous in cost. It is also conceivable to weld the protruding portion 107*a* separately, but this leads to difficulty in positioning and increase in production cost due to welding.

Incidentally, by the protruding portion 107*a* (flange portion), a magnetic path is well formed between the protruding portion 107*a* and an end portion (upper end) of the housing 103 opposing the protruding portion 107*a*, it is possible to reliably constitute the magnetic circuit 140M (see FIG. 1A).

As illustrated in FIG. 1B, when the fuel injection valve is connected to the fuel pipe 211 via the plate 251, by a fuel pressure load due to the fuel pressure of the fuel injection valve interior, the fixed core 107 is pulled to the downstream side with respect to the adapter 140.

Figure 4B:
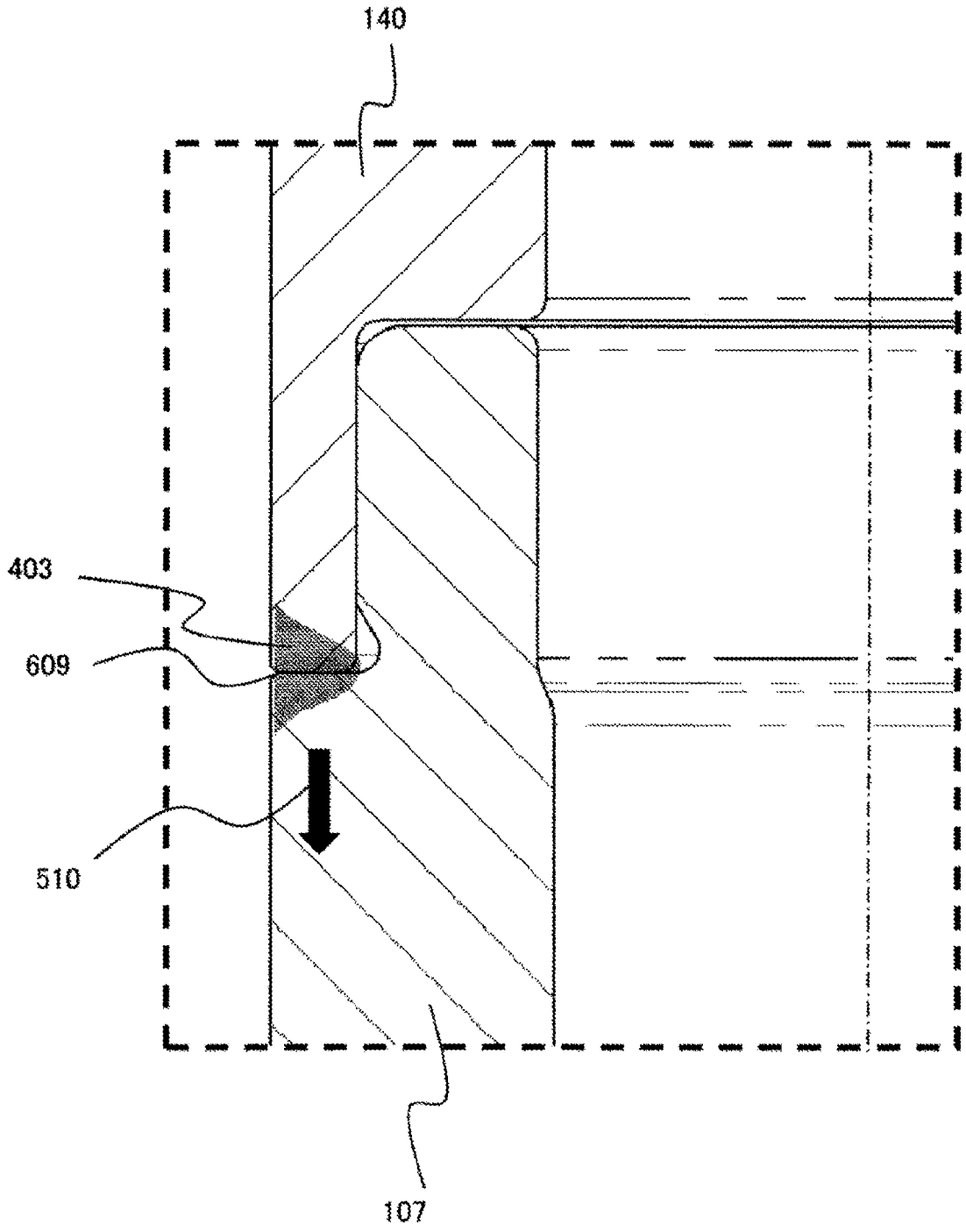
FIG. 4B is an enlarged cross-sectional view of the weld portion of the fuel injection device according to the embodiment of the present invention.

FIG. 4B illustrates an enlarged sectional view of an abutting weld portion when the adapter 140 of the fuel injection valve and the fixed core 107 are subjected to abutting welding. The shape of the re-solidified metal melted by welding is indicated by 403. An abutting surface 609 of the adapter 140 and the fixed core 107 are perpendicular to amain load direction 510. Therefore, since the load 510 is substantially uniformly received by the abutting surface 609, the maximum stress generated is smaller than that of the lap welding illustrated in FIG. 3B.

That is, the fuel injection valve of this embodiment includes the attachment portion 401 (first component) of the adapter 140, and the attachment portion 402 (second component) of the fixed core 107 having an opposing surface (upstream surface) opposing one surface (downstream surface) of the first component. Further, a butting surface that makes mutual contact between the one surface (downstream surface) of the first component and the opposing surface (upstream surface) of the second component is formed, and at this abutting surface, the abutting weld portion 403 is formed so as to be along the butting surface. Further, an air gap is formed by the abutting weld portion 403 and the first component and the second component, and a welding direction tip end portion of the abutting weld portion 403 is formed so as to be positioned on a welding direction side (right direction in FIG. 4B) with respect to the welding direction tip end portion of the butting surface.

At the upper side of the air gap, a press-fitting portion in which the attachment portion 401 (first component) of the adapter 140 and the attachment portion 402 (second component) of the fixed core 107 are press-fitted in the radial direction is formed. That is, in addition to this press-fitting portion, the attachment portion 401 (first component) of the adapter 140 and the attachment portion 402 (second component) of the fixed core 107 are firmly fixed by the abutting weld portion 403 described above. According to the method illustrated in FIG. 3B, there is a risk that the fixing strength may be insufficient due to concentration of the stress in the welded portion at that time. However, by the method of FIG. 4B, a fixing strength can be improved.

As a result, the abutting weld portion 403 is welded so as to have strength enough to withstand a fuel pressure load. For abutting welding, the joint efficiency is high for lap welding which is performed in a conventional fuel injection valve, and the strength is improved against the same penetration amount.

Figure 4C:
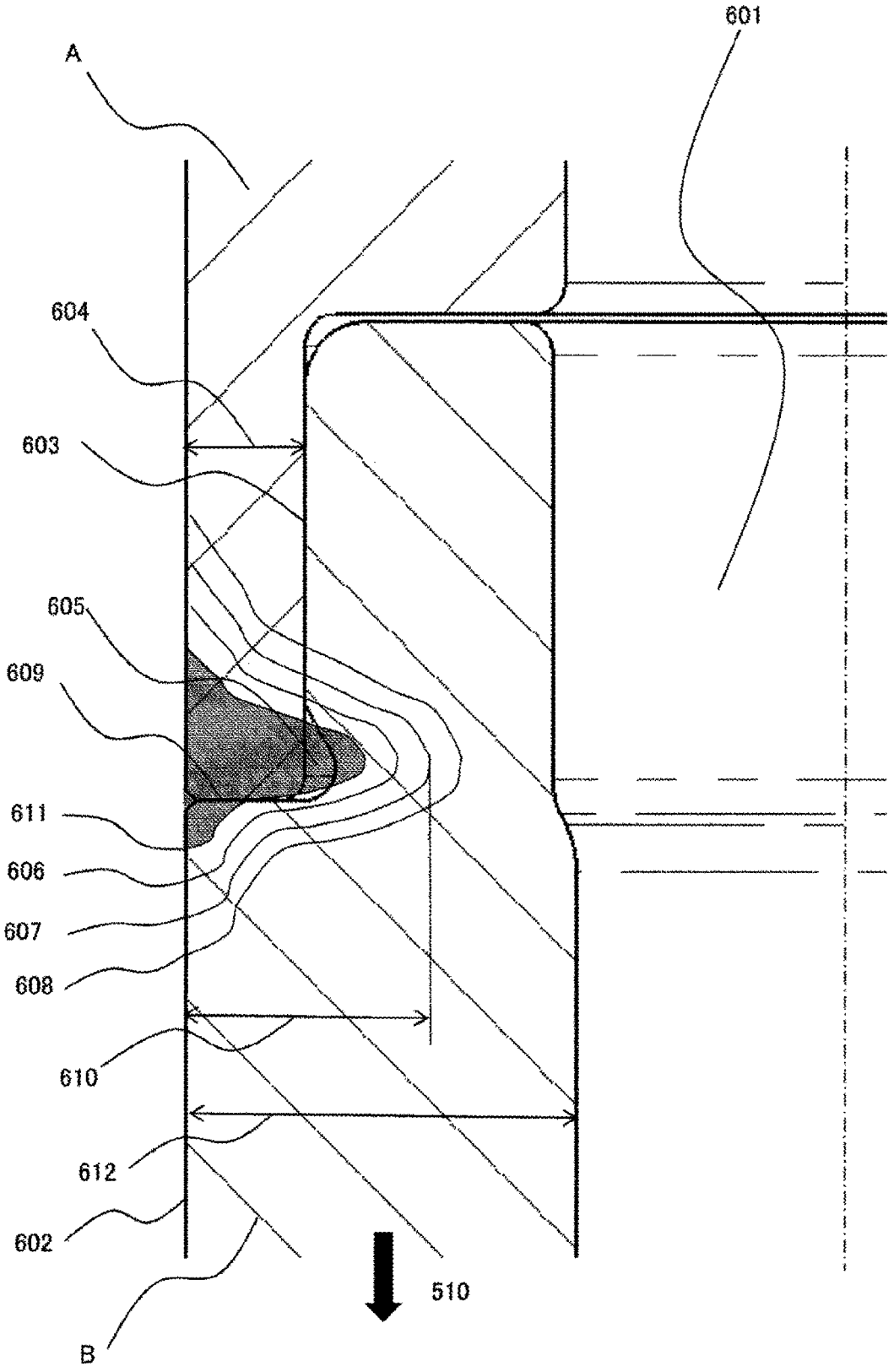
FIG. 4C is an enlarged cross-sectional view of the weld portion of the fuel injection device according to the embodiment of the present invention.

FIG. 4C illustrates the shape of melting and re-solidification by welding of the abutting portion further enlarged. In the abutting of two components, a gap 605 is formed by digging a corner side of a member B as illustrated in FIG. 4C or chamfering a corner portion of a member A (not illustrated) so that the abutting surface 609 is in close contact. When welding the abutting portion, laser welding is performed in a shape as illustrated in 606 in order to completely fill the aforementioned gap 605 with molten metal. The reason why the gap 605 is filled with molten metal is that in a case where a load in an arrow direction in FIG. 4C is applied to the two components, the stress increases depending on the shape of a gap portion, and there is a possibility of lowering the strength of the weld portion. That is, even in abutting welding, the shape of the weld portion protruding into a butting gap may cause stress concentration.

On the other hand, as illustrated in FIG. 4, with respect to the press-fitting portion where the welding direction tip end portion is press-fitted in the radial direction between the attachment portion 401 (first component) of the adapter 140 and the attachment portion 402 (second component) of the fixed core 107, abutting weld portions 606, 607, and 608 are further positioned on a welding direction side (right direction in FIG. 4C). The weld portions 606, 607, and 608 are formed so as to fill all the gaps formed between the first component 401 and the second component 402 before welding. As a result, stress increases due to the shape of the gap portion, and the risk of lowering the strength of the weld portion can be suppressed.

A penetration depth 610 of the welding has variations with respect to a target in manufacturing processing. Even if welding is performed with the penetration shape of 606 as a target, in fact, a smaller penetration shape 611 is obtained, and there is a possibility that a gap will remain after welding. Therefore, in order to fill all the gaps 605 in FIG. 4C with the molten metal, a welding shape 607 is aimed so that even if the variation occurs and the penetration depth becomes small, a penetration shape 606 is obtained.

On the other hand, since coaxial precision is required for the fuel injection valve, there is a demand to make the heat input amount as small as possible during welding. In the case of the welding shape illustrated in FIG. 4C, even when aiming at a penetration shape of 607, considering the occurrence of the above-described variations, it is conceivable that penetration is made into a shape 608 having a large penetration. However, in such a case that more than two-thirds of the thickness 612 of the part B is melted, there is a possibility that the amount of deformation during welding is large and the coaxial accuracy of the fuel injection valve is deteriorated.

Figure 4D:
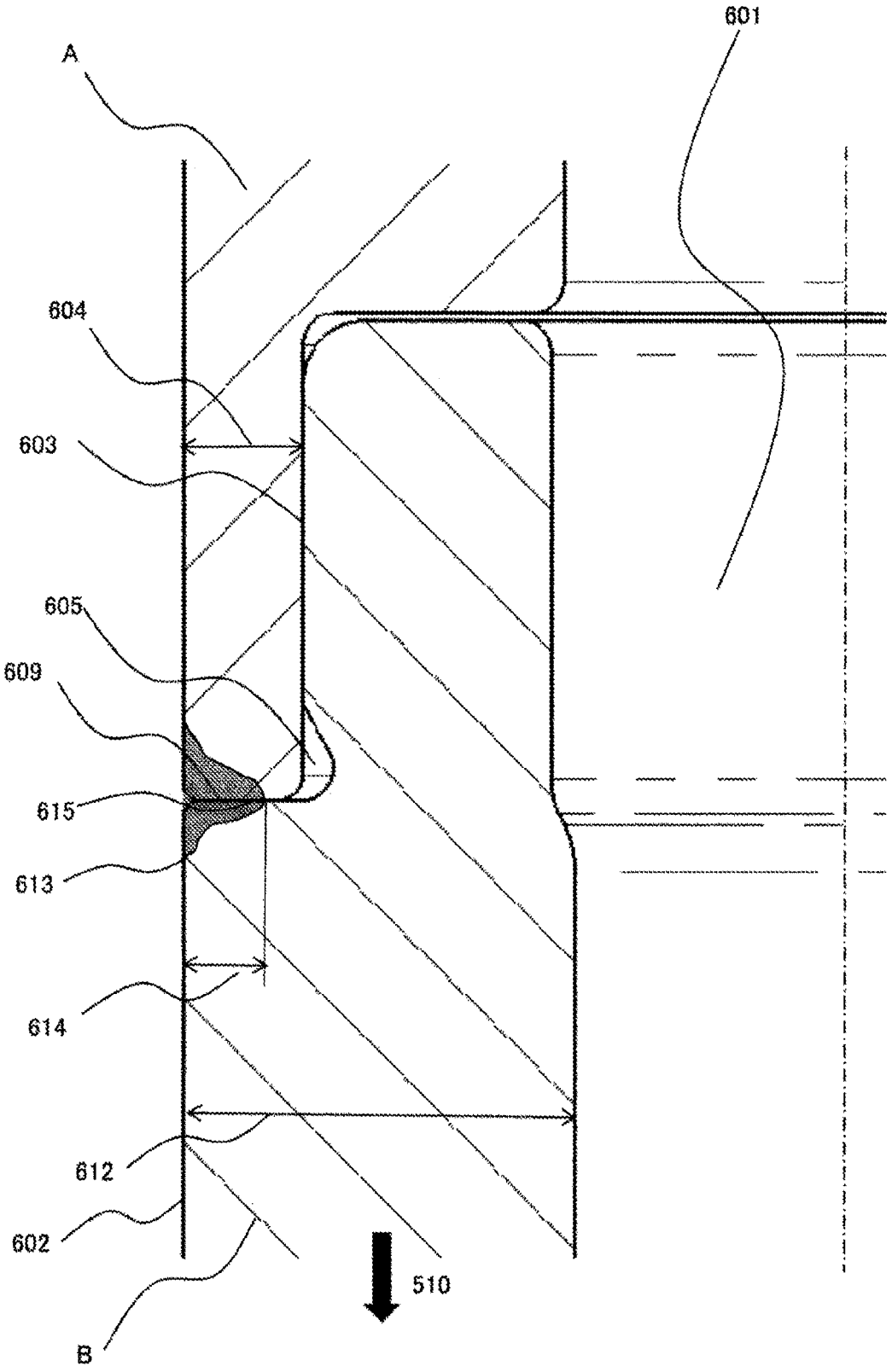
FIG. 4D is an enlarged cross-sectional view of the weld portion of the fuel injection device according to the comparative example.

FIG. 4D illustrates a weld portion shape when a penetration depth of abutting welding is set to 614 in order to suppress coaxial deterioration. It is evident that an end portion 615 having a weld portion shape end 615 draws stress concentration relative to a load direction 600 when the penetration depth is less than the butting length. Therefore, even in abutting welding, if a weld penetration shape is made shorter than an abutting welding length, there is a possibility that it is impossible to secure sufficiently high rigidity and strength against the load caused by high fuel pressure.

Figure 5A:
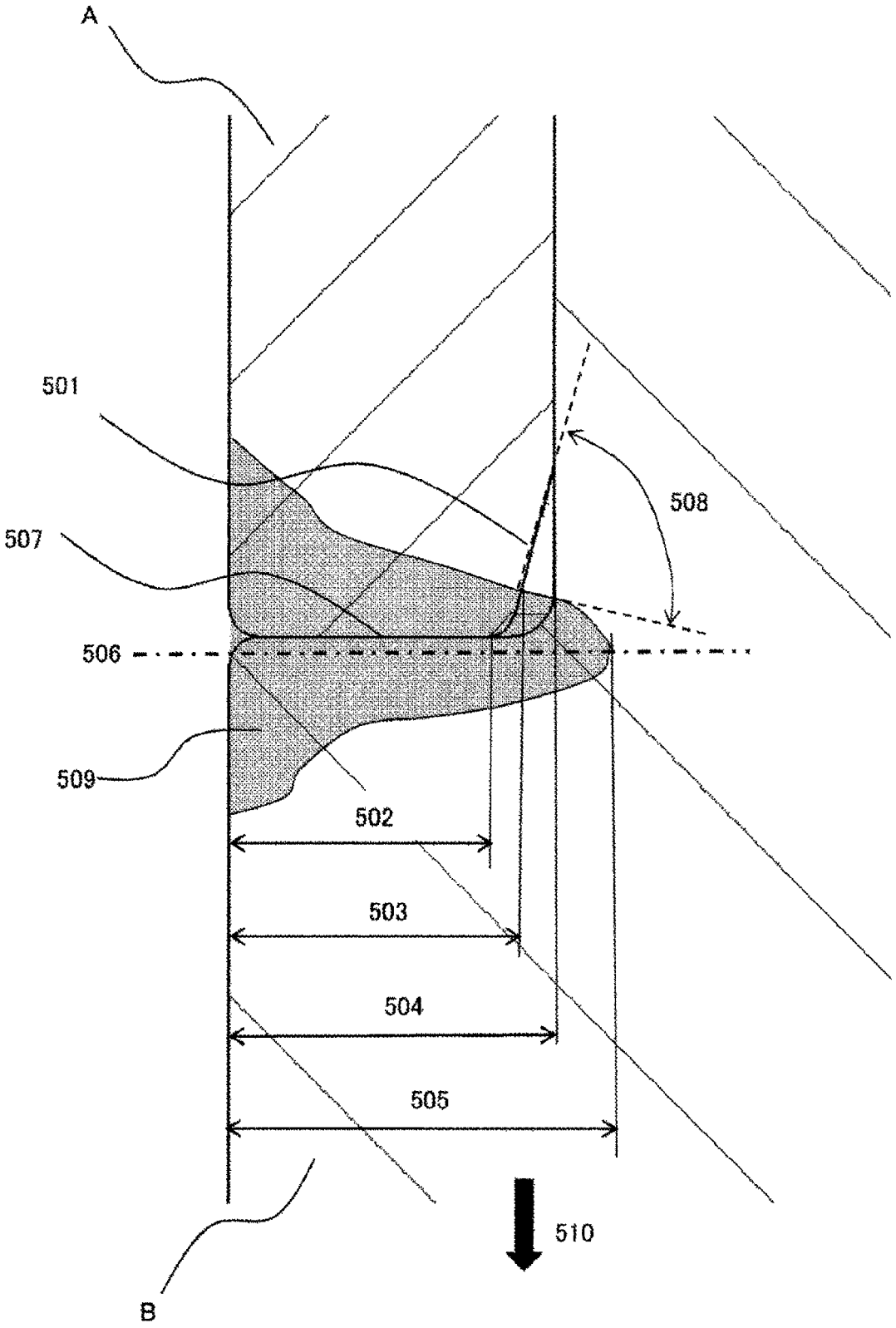
FIG. 5A is an enlarged cross-sectional view of the weld portion of the fuel injection device according to the embodiment of the present invention.

FIG. 5A illustrates a component constituting a fuel boundary and its welding shape according to an embodiment of the fuel injection device of the present invention. A boundary between a high pressure fuel and an atmosphere includes two or more components A and B. The components are fitted and press-fitted on the small diameter side outer diameter of the component provided with the stepped part and on the inner diameter side of the other part, and are brought into contact with the butting surface and positioned. A welding direction tip end portion in FIG. 4, which is the component A, corresponds to the attachment portion 401 (first component) of the adapter 140. The component B corresponds to the attachment portion 402 (second component) of the fixed core 107. Abutting welding is performed from a direction nearly parallel to a butting surface between the first component A and the second component B to form an abutting weld portion 509.

In the first component A to be fitted or press-fitted on the inner diameter side, a chamfer 501 is provided in which the inner diameter side corner portion of the butting surface is long in a direction perpendicular to the butting surface. The abutting weld portion 509 is formed so that a welding coupling length 503 is larger than a butting length 502 between the first component A and the second component B. That is, a welding direction tip end portion of the abutting weld portion 509 is positioned on a welding direction side with respect to the welding direction tip end portion of an air gap formed by the first component A, the second component B, and the abutting weld portion 509 (right direction in FIG. 5A).

A weld penetration depth 505 of the abutting weld portion 509 is set to a press-fit depth 504 or more. The press-fit depth refers to the length of the abutting weld portion 509 in a press fitting direction. A weld penetration center 506 is positioned on the component side fitted and press-fitted on the outer diameter side of a butting surface 507. That is, a central portion 506 in a direction orthogonal to the welding direction (right direction in FIG. 5A) of the abutting weld portion 509 (vertical direction in FIG. 5A) is positioned in an abutting direction side (lower side direction in FIG. 5A) rather than the butting surface 507.

The abutting weld portion 509 represents a shape melted and re-solidified by welding. At a position at which the abutting weld portion 509 which is melted and re-solidified metal intersects the first member A, that is, at an end portion of the welding coupling length 503 of the portion out of the abutting weld portion 509 fixed by being welded to the first member A, an angle made by a tangent to be drawn to a portion forming the air gap out of the abutting weld portion 509 melted and re-solidified, and a tangent to be drawn to a surface 501 forming the air gap with the abutting weld portion 509 of the first component A is set to 508. As described above, in this embodiment, the surface 501 forming an air gap with the abutting weld portion 509 of the first component A is formed by chamfering.

Further, the first component A and the second component B are fixed by press-fitting on a side surface substantially orthogonal to an opposing surface (butting surface 507), and an air gap is formed on a press-fitting side (lower direction in FIG. 5A) with respect to a press-fitting surface (press-fitting portion) that fixes the second component B and the first component A. As illustrated in FIG. 5A, the chamfered portion 501 is formed in a direction away from the press-fitting surface (press-fitting portion) toward the press-fitting direction (downward direction in FIG. 5A) at a press fitting direction end portion of the first component A. Further, the chamfered portion 501 is formed such that a length in a press-fitting direction is longer than a length in a direction orthogonal to the press-fitting direction (horizontal direction in FIG. 5A). Further, it is desirable that the air gap is formed such that a length in the abutting direction (the lower direction in FIG. 5A) is longer than a length in a direction orthogonal to the abutting direction (horizontal direction in FIG. 5A).

In comparison with the comparative example illustrated in FIG. 4D, since the angle 508 formed by the end portion of the weld portion shape with respect to the load direction 510 is large, an increase in stress due to stress concentration is reduced, so that the strength of the weld portion can be kept. The angle 508 is desirably near 180 degrees, and if the angle 508 is 45 degrees or more, a desired fixing strength can be kept in the fuel injection valve.

Figure 5B:
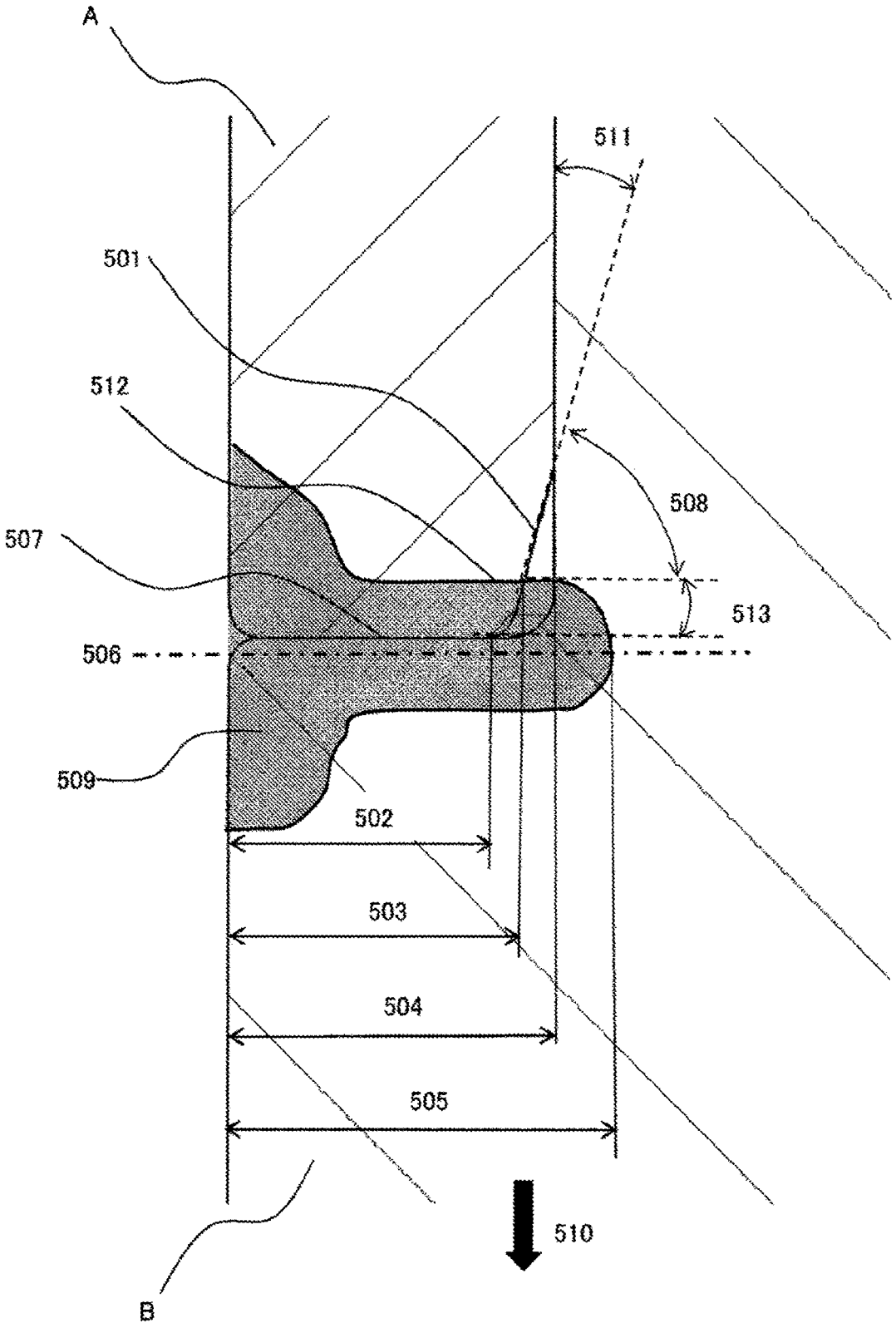
FIG. 5B is an enlarged cross-sectional view of the weld portion of the fuel injection device according to the embodiment of the present invention.

With reference to FIG. 5B, the details of the chamfered portion 501 and the shape of the abutting weld portion 509 melted and re-solidified will be described. As described above, when the length of the welding coupling length 503 is equal, as the angle 508 formed by the abutting weld portion 509 and the chamfered portion 501 is larger, stress concentration can be more relaxed. An angle 513 between an upper surface portion 512 of the abutting weld portion 509 and the butting surface 507 is such that the angle is at most parallel in view of laser welding characteristics. Therefore, in order to make the angle 508 between the upper surface portion 512 of the abutting weld portion 509 and the chamfer 501 as large as possible, it is preferable that an angle 511 formed by the chamfer 501 of the first component A is small. However, if the angle is too small, it is impossible to secure the press-fit distance between the component A and the component B, so that the angle is set to about 30 degrees (20 degrees≤angle 511≤40 degrees), for example.

As described above, in the fuel injection device of the present embodiment, a boundary between a high pressure fuel and an atmosphere includes two or more components. The components are fitted and press-fitted on the small diameter side outer diameter of the component provided with the stepped part and on the inner diameter side of the other part, and are brought into contact with the butting surface and positioned. Abutting welding is performed from a direction nearly parallel to the butting surface. In addition, the first component A to be fitted, and press-fitted on the inner diameter side has a chamfer 501 in which the inner diameter side corner portion of the butting face is long in a direction perpendicular to the butting face. Further, the weld penetration depth is equal to or greater than the thickness of the press-fitting portion of the first component A to be fitted, and press-fitted on the inner diameter side, and the center in the press-fitting direction of the welding is positioned on the side of the second component B which is fitted and press-fitted on the outer diameter side of the butting surface.

Figure 6A:
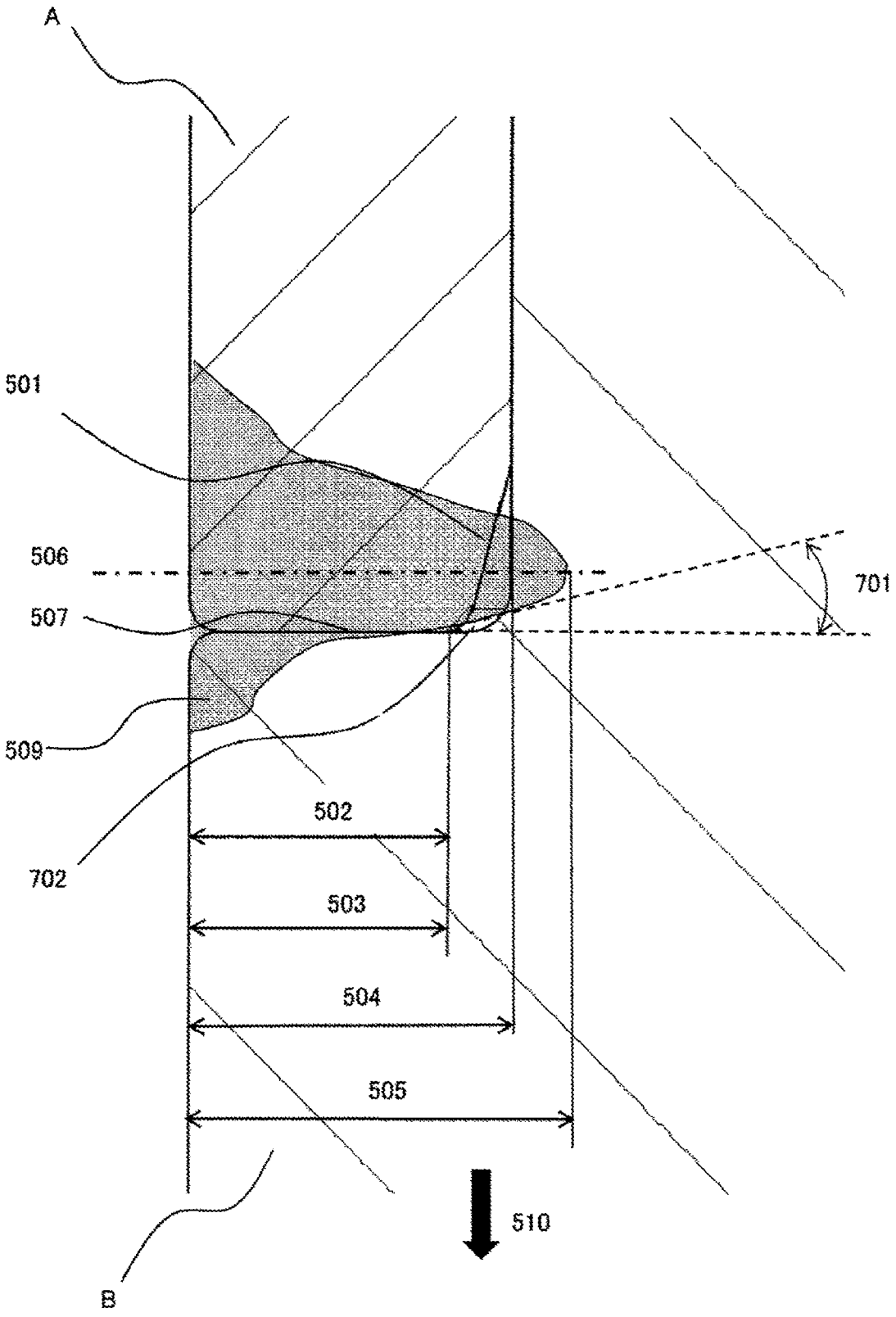
FIG. 6A is an enlarged cross-sectional view of the weld portion of the fuel injection device according to the comparative example.
Figure 6B:
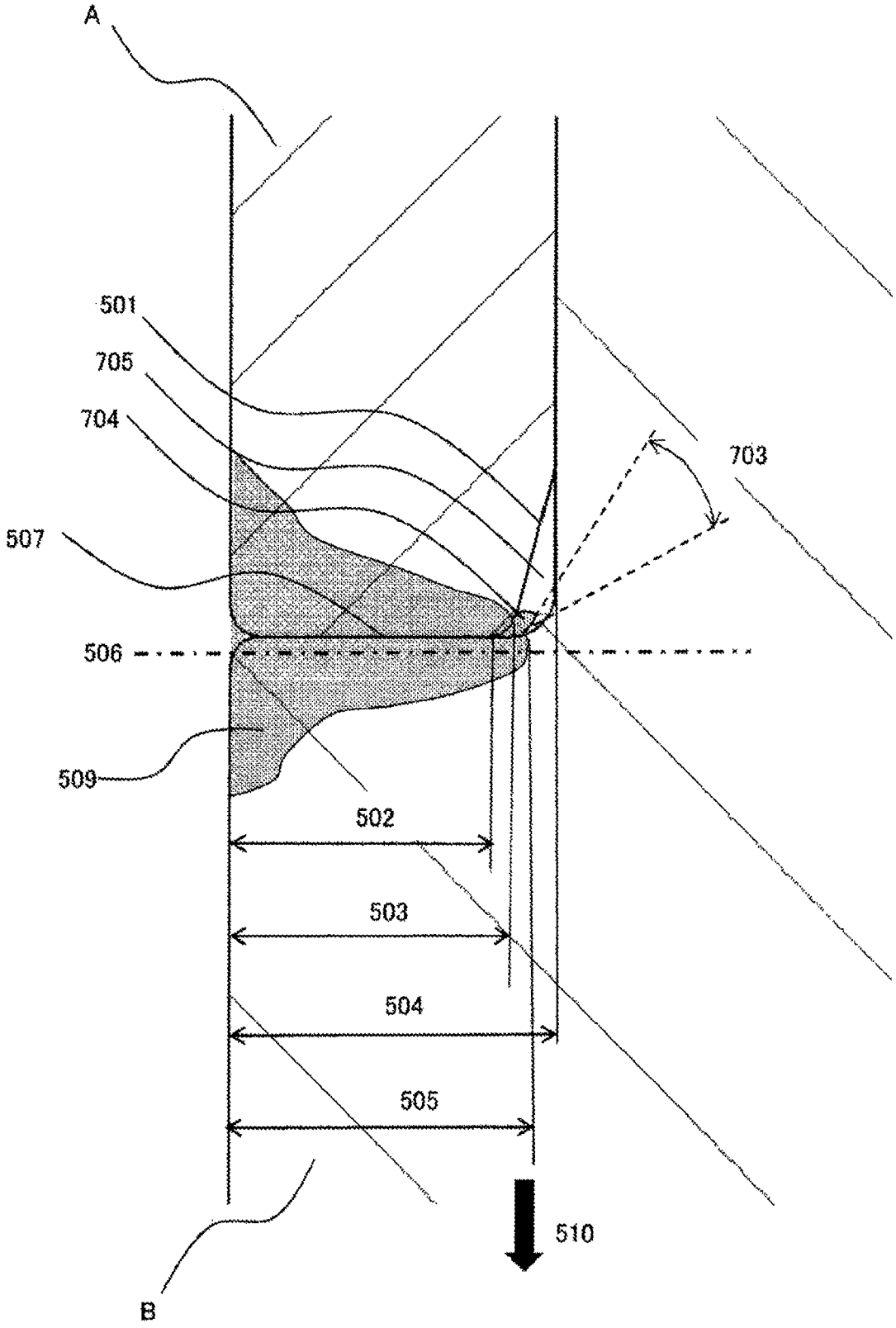
FIG. 6B is an enlarged sectional view of the weld portion of the fuel injection device according to the comparative example.

With reference to FIGS. 6A and 6B, a fact that this embodiment can secure the strength capable of withstanding a high fuel pressure in various cases will be described using a counter example. FIG. 6A illustrates a case where a welding center position deviates to the side of the first component A in FIG. 6A for a targeted position. A small gap 702 remains at the abutting weld portion 509 which is the molten and re-solidified metal after welding and at the corner portion of the second component B. Since an angle 701 formed by the end portion of the weld portion shape is smaller than an axial load 600 caused by the fuel pressure, stress concentrates and the stress is increased: therefore, this gap shape reduces the strength of the weld portion. As described above, it is necessary to position a weld penetration center 506 on the component side fitted and press-fitted on the outer diameter side of a butting surface 507.

FIG. 6B illustrates a case where the penetration depth 505 is shallower than press-fit depth 504. In the case of such a welding shape, there is a possibility that a part 704 of the metal 509 after molten and re-solidified locally bulges and protrudes into a gap 705 between the first component A and the second component B. Since an angle 703 formed by the end portion of the weld portion shape is smaller than an axial load 600 caused by the fuel pressure, stress concentrates and the stress is increased: therefore, this gap shape reduces the strength of the weld portion. As described above, it is necessary to make the weld penetration depth 505 deeper than the press-fit depth 504.

FIG. 5 illustrates a case where a welding center position deviates to the side of the second component B for a targeted position. Since the angle 508 formed by the end portion of the weld portion shape with respect to the load direction 600 is large, an increase in stress due to stress concentration is reduced, so that the strength of the weld portion can be kept to the minimum.

Further, advantageously, the welding shape of the embodiment of the present invention illustrated in FIG. 5 does not require a complicated shape for the first component A and the second component B, and does not increase the manufacturing cost of component. Further, there is no need to change the position or angle of penetration center 506 during laser welding, so that there is a merit that the cost of the welding equipment is not increased. Further, since the position and angle of penetration center 506 are not changed during laser welding, the time required for welding does not increase, so that the cost increase of the welding equipment can be suppressed.

Thus, according to the embodiment of the present invention illustrated in FIG. 5, it is possible to realize an abutting welding structure that minimizes penetration amount of the abutting welding portion and suppresses transient stress concentration against load while reducing time required for welding and facility cost.

It should be noted that the present invention is not limited to the above-described embodiments, but includes various modifications. For example, the above-described embodiments have been described in detail for easy understanding of the present invention, and are not necessarily limited to those having all the configurations described. In addition, a part of the configuration of one embodiment can be replaced by the configuration of another embodiment, and the configuration of another embodiment can be added to the configuration of one embodiment. Further, it is possible to add, delete, and replace other configurations with respect to part of the configuration of each embodiment.

REFERENCE SIGNS LIST

22 small diameter cylindrical portion of injection hole cup support
23 large diameter tubular portion of injection hole cup support
39 valve seat portion (seat portion of seat member)
43A connector
101 injection hole cup support
102 mover
103 housing
104 coil bobbin
105 electromagnetic coil (solenoid)
107, 407 fixed core (stator)
107D stator through hole (fuel passage)
109 conductor
110 spring
112 zero spring
113 needle valve guide (shoulder)
114 movable portion
114A needle valve
114B valve body tip end portion
114C head portion of needle valve (spring guide projection)
115 guide portion
116 injection hole cup
117 fuel injection hole
121 resin molded body
126 fuel passage
127 guide portion
128 through hole
136 gap
140 adapter (pipe)
201 guided part of valve body tip end
202 guiding part of injection hole cup
203 valve element seat portion at valve body tip end
215 tapered surface of housing
251 plate
301 lap weld portion
302 boundary surface during lap welding
303 upper end of boundary surface 302
304 lower end of boundary surface 302
305, 510 load direction
401 attachment portion of adapter 140
402 attachment portion of fixed core 107
403 abutting welding portion
501 chamfer
502 butting length
503 welding coupling length
504 press-fit depth
505 weld penetration depth
506 weld penetration center
507 butting surface
508, 701, 703 angle
509 melting, re-solidified metal (abutting weld portion)
601 fuel injection valve interior
605, 702, 705 gap
606, 607, 608, 611, 613 welding shape
609 abutting surface
610, 614 penetration depth
612 thickness of component B
615 end portion having shape of weld portion
704 part of metal after melting and re-solidification

The invention claimed is:

1. A flow control device including a first component having a first surface and a second component having an opposing second surface facing the first surface of the first component, comprising:

an abutment at which the first surface of the first component and the opposing second surface of the second component mutually contact each other; and a weld portion formed along the abutment, an air gap formed by the weld portion, the first component, and the second component, wherein a welding direction tip end portion of the weld portion is positioned on a welding direction side with respect to the welding direction tip end portion of the abutment; and wherein a central portion in a direction orthogonal to a welding direction of the weld portion is positioned on an abutting direction side with respect to the abutment.

2. The flow control device according to claim 1, wherein the welding direction tip end portion of the weld portion is positioned on a welding direction side with respect to a welding direction tip end portion of the air gap.

3. The flow control device according to claim 1, comprising a press-fitting portion that fixes the first component and the second component on a side surface of the second component, the side surface being substantially orthogonal to the opposing first surface with the first component, wherein the air gap is formed on a press-fitting direction side with respect to the press-fitting portion of the second component and the first component.

4. The flow control device according to claim 1, comprising a press-fitting portion that fixes the first component and the second component on a side surface of the second component, the side surface being substantially orthogonal to the opposing surface with the first component, wherein a chamfered portion formed in a direction away from the press-fitting portion toward a press-fitting direction is formed at an end portion in a press-fitting direction of the first component.

5. The flow control device according to claim 1, comprising a press-fitting portion that fixes the first component and the second component on a side surface of the second component, the side surface being substantially orthogonal to the opposing surface with the first component, wherein a chamfered portion formed in a direction away from the press-fitting portion toward a press-fitting direction is formed at an end portion in a press-fitting direction of the first component, and the chamfered portion is formed such that a length in a press-fitting direction is longer than a length in a direction orthogonal to the press-fitting direction.

6. The flow control device according to claim 1, wherein the air gap is formed such that a length in an abutting direction is longer than a length in a direction orthogonal to the abutting direction.

7. The flow control device according to claim 1, wherein an angle made by a tangent to be drawn to a portion forming the air gap out of the abutting weld portion, and a tangent to be drawn to a surface forming the air gap with the abutting weld portion of the first component is set to 45 degrees or more.

8. The flow control device according to claim 1, comprising a press-fitting portion that fixes the first component and the second component on a side surface of the second component, the side surface being substantially orthogonal to the opposing surface with the first component, wherein a chamfered portion formed in a direction away from the press-fitting portion toward a press-fitting direction is formed at an end portion in a press-fitting direction of the first component, and the chamfered portion is formed such that a length in a press-fitting direction is longer than a length in a direction orthogonal to the press-fitting direction, and the angle formed by the press-fitting portion and the chamfered portion is 20 degrees or more and 40 degrees or less.

9. The flow control device according to claim 1, comprising a valve body that opens and closes a flow path, wherein the second component is a magnetic core that generates a magnetic attraction force, and the first component is a fixing member to which the magnetic core is fixed while being butted in a moving direction of the valve body.

10. The flow control device according to claim 1, wherein a length of the weld portion is greater than a length of the abutment.

11. The flow control device according to claim 1, wherein a penetration depth associated with the weld portion is based on a press-fit depth associated with the press-fit portion.

12. The flow control device according to claim 11, wherein the penetration depth is greater than the press-fit depth.

* * * * *